US005637007A

United States Patent [19]

Suzuki et al.

[11] Patent Number: 5,637,007

[45] Date of Patent: Jun. 10, 1997

[54] CONNECTOR DEVICE

[75] Inventors: Toshifumi Suzuki; Hitoshi Sakai, both of Shizuoka, Japan

[73] Assignee: Yazaki Corporation, Tokyo, Japan

[21] Appl. No.: 530,519

[22] Filed: Sep. 19, 1995

[30] Foreign Application Priority Data

Sep. 19, 1994 [JP] Japan ..... 6-223750

[51] Int. Cl.[6] ..... H01R 13/52

[52] U.S. Cl. ..... 439/276; 439/936

[58] Field of Search ..... 439/276, 204, 439/736, 936

[56] References Cited

U.S. PATENT DOCUMENTS 4,662,692 5/1987 Uken et al. ..... 439/936

4,976,634 12/1990 Green et al. ..... 439/936

FOREIGN PATENT DOCUMENTS 419978 1/1990 Japan ..... 439/276

*Primary Examiner*—Neil Abrams

*Assistant Examiner*—Brian J. Biggi

*Attorney, Agent, or Firm*—Sughrue, Mion, Zinn, Macpeak & Seas

[57] ABSTRACT

There is provided a connector device for a hydraulic circuit, in which female and male connector housings can be positively fitted together completely, and female and male terminals can be positively connected electrically. Terminals are passed at their central portions through respective terminal passage holes in a housing casing, and a liquid-state sealer is poured into an insertion hole in which rear portions of the terminals are disposed, and is cured to close the insertion hole. A leak portion collecting portion for collecting an outflow portion of the sealer leaked from each of the terminal passage holes through a surface of the associated terminal when pouring the sealer is provided at an end of the terminal passage hole.

4 Claims, 5 Drawing Sheets

CONNECTOR DEVICE

BACKGROUND OF THE INVENTION

1. Field of the Invention

This invention relates to a connector device, and more particularly to a connector device for connecting a sheathed wire, connected to a control element of a hydraulic circuit mounted within a housing of an automatic transmission, to a control device provided outside of the housing.

2. Background

A conventional automatic transmission includes a torque converter and a gear change mechanism, and the rotation of an engine, outputted through a crankshaft, is transmitted to an input shaft through the torque converter, and is further transmitted to the gear change mechanism.

A multiple disc brake or a multi-disc clutch is provided in the gear change mechanism, and the gears are changed by engaging and disengaging this frictional engagement device.

The engagement and disengagement of these elements is effected by a hydraulic circuit, and a valve, a hydraulic servo motor, an accumulator and so on are provided in the hydraulic circuit, and a solenoid valve is provided for producing hydraulic signals for these elements.

A solenoid for actuating the solenoid valve is attached to a valve body, and the solenoid is housed in a transmission casing. Therefore, the solenoid valve, a hydraulic sensor and so on are connected to a controller through an opening formed in the transmission casing. A sealer is provided integrally in a connector mounted in this opening so that oil in an oil pan will not leak through the interior of the connector to the outside of the transmission casing by the capillary action.

One such conventional connector is shown in FIG. 5, which is a cross-sectional view thereof. In this Figure, a tubular casing 51 has at one end thereof an insertion hole 53 for receiving wires 52, and also has at the other end a terminal hole 55 for receiving terminals 54. A partition wall 56 is formed at a central portion of the interior of the casing 51, and a plurality of terminal passage holes 57 are formed through this partition wall 56.

Each of the wires 52 comprises a sheathed wire, and a sheath-peeled portion thereof is connected to a respective one of the terminals 54 by clamping or the like. The terminals 54 are passed through the terminal passage holes 57, respectively, and then a resin 58 serving as a sealer is poured into the casing to fill the casing, so that the wires 52 and the terminals 54 are fixedly secured to the casing 51 by the resin 58.

In the above conventional technique, however, the liquid-state resin sealer, when poured into the casing, often leaks through a gap between each terminal passage hole 57, formed through the terminal support wall 56 within the housing casing 51, and the associated terminal 54, extending through the terminal passage hole 57, to a fitting surface of the terminal support wall 56. More specifically, the resin 58 flows from the insertion hole 53 to the terminal hole 55 through the gap between the terminal passage hole 57 in the partition wall 56 and the terminal 54, thus forming a bulged flow-out portion 60A at a region between the surface of the terminal 54 and the outer surface of the partition wall 56, as shown at a left portion of FIG. 6. This flow-out portion 60A is formed into an agglomerate upon curing of the resin. This agglomerate of the resin is an obstacle to the advance of a guide portion of a mating connector housing C51, so that the connector device C50 and the mating connector C51 cannot be completely fitted together.

Furthermore, as shown at a right portion of FIG. 6, the leaked liquid-state sealer spreads or diffuses over the surface of the front end portion of the terminal 54 to form a covering layer 60B thereon, so that there is a possibility that the terminal 62 incompletely contacts a mating terminal.

Recently, automatic transmissions have advanced in quality, and not only electric parts but also sensors and electrically-operated actuators have been extensively used, so that the number of wires inserted into connector devices has increased. With the increase in the number of the wires, the number of wire insertion holes increases, and the leakage of liquid-state sealer may also increase.

SUMMARY OF THE INVENTION

It is an object of this invention to overcome the above problems of conventional connectors, and more specifically to provide a connector device for a hydraulic circuit in which female and male connector housings can be positively fitted together completely, and female and male terminals can be positively connected electrically.

The above object has been achieved by a connector device wherein terminals are passed at their central portions through respective terminal passage holes in a housing casing; and a liquid-state sealer is poured into an insertion hole in which rear portions of the terminals are disposed, and is cured to close the insertion hole;

The connector of the invention features a leak portion collecting portion, for collecting an outflow portion of the sealer leaked from each of the terminal passage holes through a surface of the associated terminal when pouring the sealer, at an end of the terminal passage hole.

According to another aspect of the invention, there is provided a connector device comprising a tubular housing casing; a plurality of wires each having a sheath at its outer periphery; and a plurality of terminals connected respectively to peeled portions of the wires, wherein the housing casing has at one end an insertion hole receiving the wires, and has at the other end a fitting hole into which front end portions of the terminals project; The fitting hole receives to a mating connector; the housing has a terminal support wall separating the insertion hole and the fitting hole from each other, that surface of the terminal support wall facing the fitting hole defines a fitting surface for the mating connector; and the terminal support wall has terminal passage holes through which the terminals are passed, respectively. A leak portion collecting portion and a surface diffusion chamber, which are continuous with each other, and are extended in a direction perpendicular to an axis of the terminal passage hole, are formed at one end of each of the terminal passage holes open to the fitting hole; and the surface diffusion chamber is deeper than the leak portion collecting portion.

In the connector device of the invention, as described above, the terminal passage holes are formed through the terminal support wall of the housing casing, and the leak portion collecting portion is formed or notched at that end of each terminal passage hole open to the fitting hole, and is extended in the direction perpendicular to the axis of the terminal passage hole. The leak portion collecting portion receives the liquid-state sealer leaking through the gap between the terminal passage hole and the terminal, thereby preventing the liquid-state sealer from flowing and diffusing to the fitting surface of the terminal support wall.

Thus, the fitting surface is maintained in a flat condition, so that the connector device and the mating connector can be completely fitted together.

In the embodiment in which the surface diffusion chamber is provided in continuous relation to the leak portion collecting portion, the surface area of the wall is increased, and a diffusion resistance is reduced, so that the diffusion of the liquid-state sealer to the surface of leak portion collecting portion and the surface of the surface diffusion chamber is accelerated. As a result, almost all of the outflow sealer is diffused over the leak portion collecting portion and the surface diffusion chamber, and is absorbed by the large capacity of these portions. Therefore, the outflow sealer will not diffuse over the surface of the terminals at all, and a covering layer resulting from the outflow sealer will not formed on the terminal, and therefore the terminal can properly contact the mating terminal.

DESCRIPTION OF THE PREFERRED EMBODIMENT OF THE INVENTION

One preferred embodiment of a connector device according to the invention will now be described with reference to the drawings.

First, the construction of this invention will be described.

Figure 1:
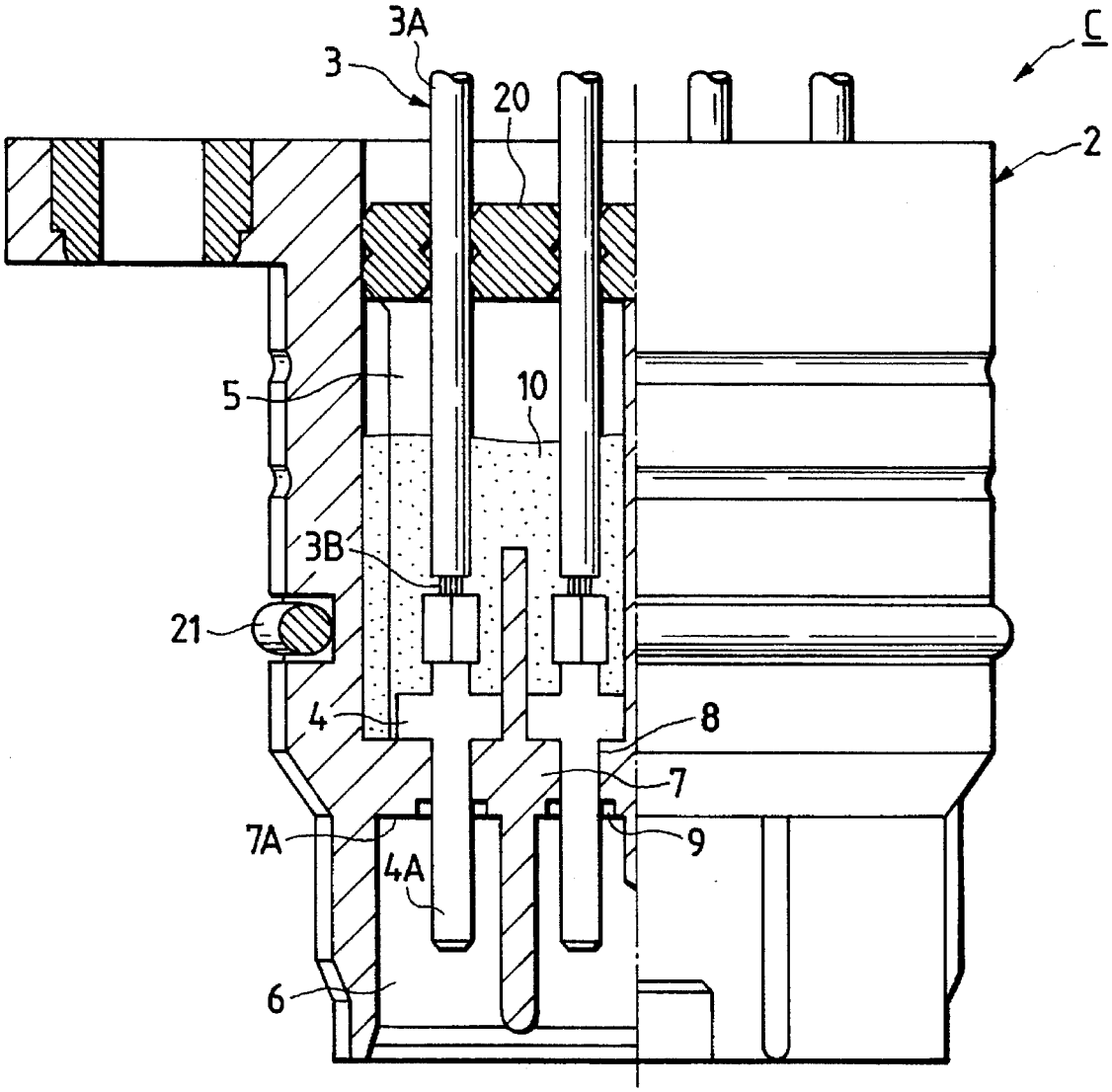
FIG. 1 is a partial cross-sectional view of a preferred embodiment of a connector device according to the present invention.
Figure 2:
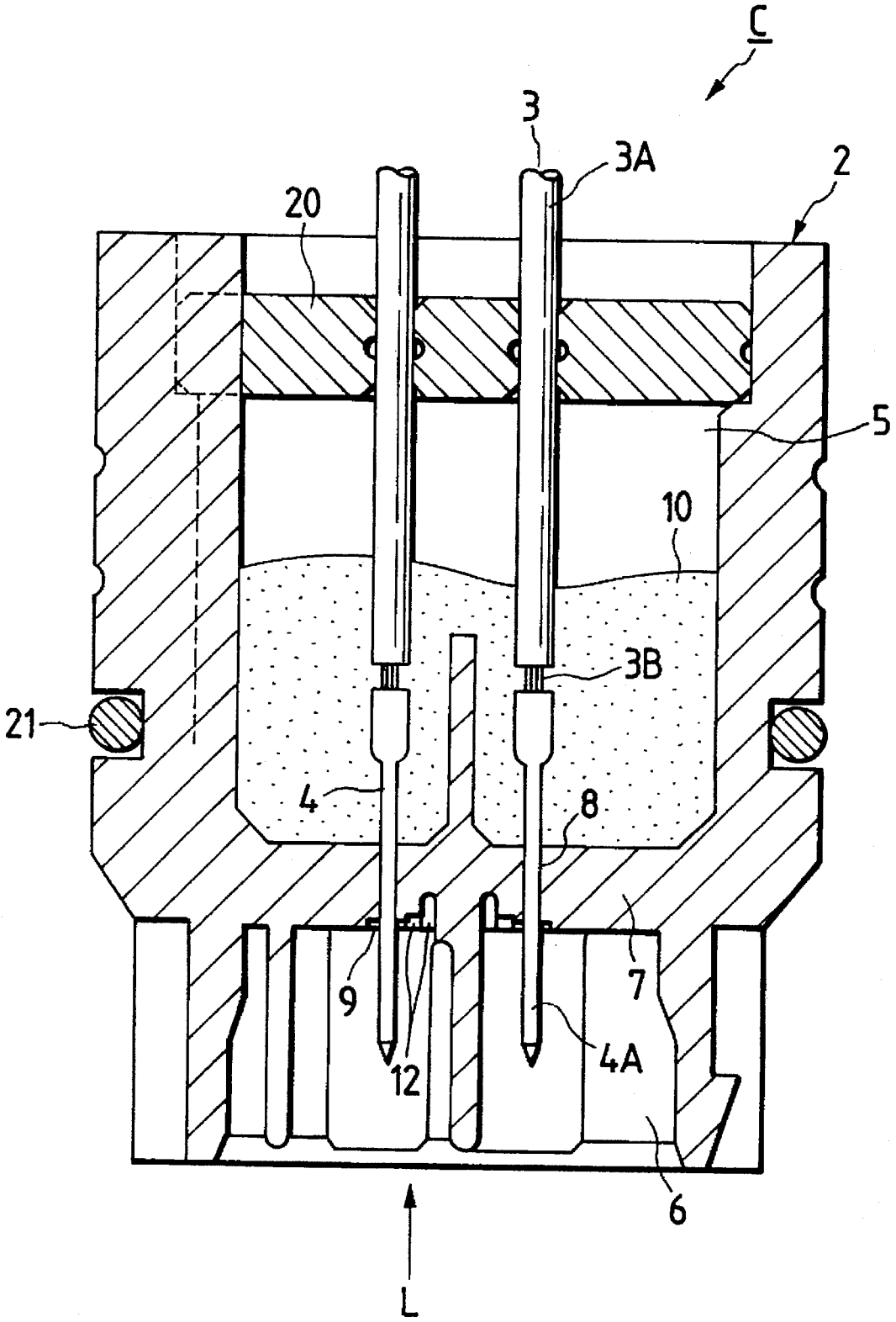
FIG. 2 is a cross-sectional view of the connector device of FIG. 1 along an axis thereof.
Figure 3:
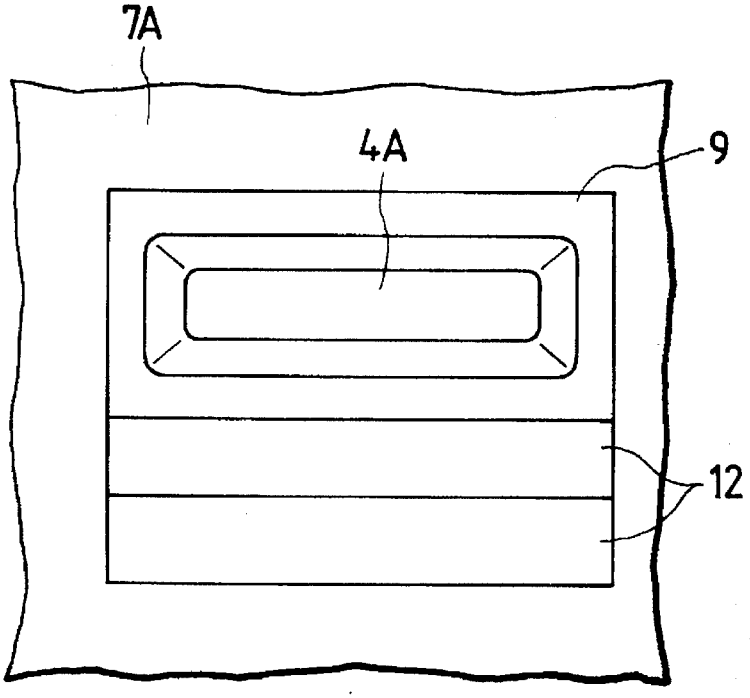
FIG. 3 is a front-elevational view of a front end of a terminal and its neighboring portion of a housing casing as seen in a direction of arrow L in FIG. 2.
Figure 5:
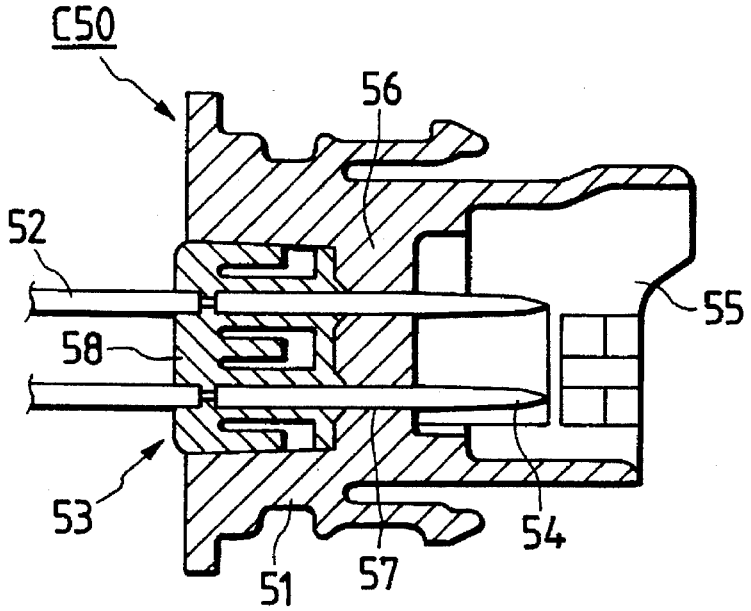
FIG. 5 is a cross-sectional view of a conventional connector device.

FIG. 1 is a partial cross-sectional view of an embodiment of the connector device of the invention, FIG. 2 is a cross-sectional view of the connector device of FIG. 1 along an axis thereof, and FIG. 3 is a front-elevational view of a front end of a terminal and its neighboring portion of a housing casing as seen in a direction of arrow L in FIG. 2.

In FIGS. 1 to 3, the connector device C of this invention comprises a tubular connector housing 2 of a synthetic resin, a plurality of wires 3 received in the connector housing 2, male terminals 4 connected respectively to front ends of the wires 3, a rubber plug 20 connected to one end of the connector housing 2 and having the wires 3 passed therethrough, and a sealer 10 which fills the connector housing 2.

The connector housing 2 has a terminal support wall 7 formed in the connector housing 2 and extending perpendicular to the axis thereof to divide the interior of the connector housing 2 into two sections. The terminal support wall 7 has a plurality of terminal passage holes 8 formed therethrough in the axial direction. Front end portions 4A of the male terminals 4 are passed through the terminal passage holes 8, respectively. An insertion hole 5 of a generally circular cross-section and a fitting hole 6 of a generally circular cross-section are formed on the opposite sides of the terminal support wall 7, respectively. The wires 3 are inserted into the insertion hole 5, and the rubber plug 20 is fitted in the insertion hole 5 adjacent to an open end thereof.

The wire 3 has a sheath 3A, and the front end of the wire 3 is stripped of the sheath 3A to provide a peeled portion 3B, and the wire 3 is fixedly connected to the associated terminal 4 at the peeled portion 3B by clamping or by the like. This fixing connection can be made by soldering, fusing or an adhesive.

The front end portions 4A of the male terminal 4 project into the fitting hole 6, and a front end portion of a housing of a mating connector fits into the fitting hole 6. That side or surface of the terminal support wall 7 exposed to the fitting hole 6 defines a flat fitting surface 7A.

Figure 4:
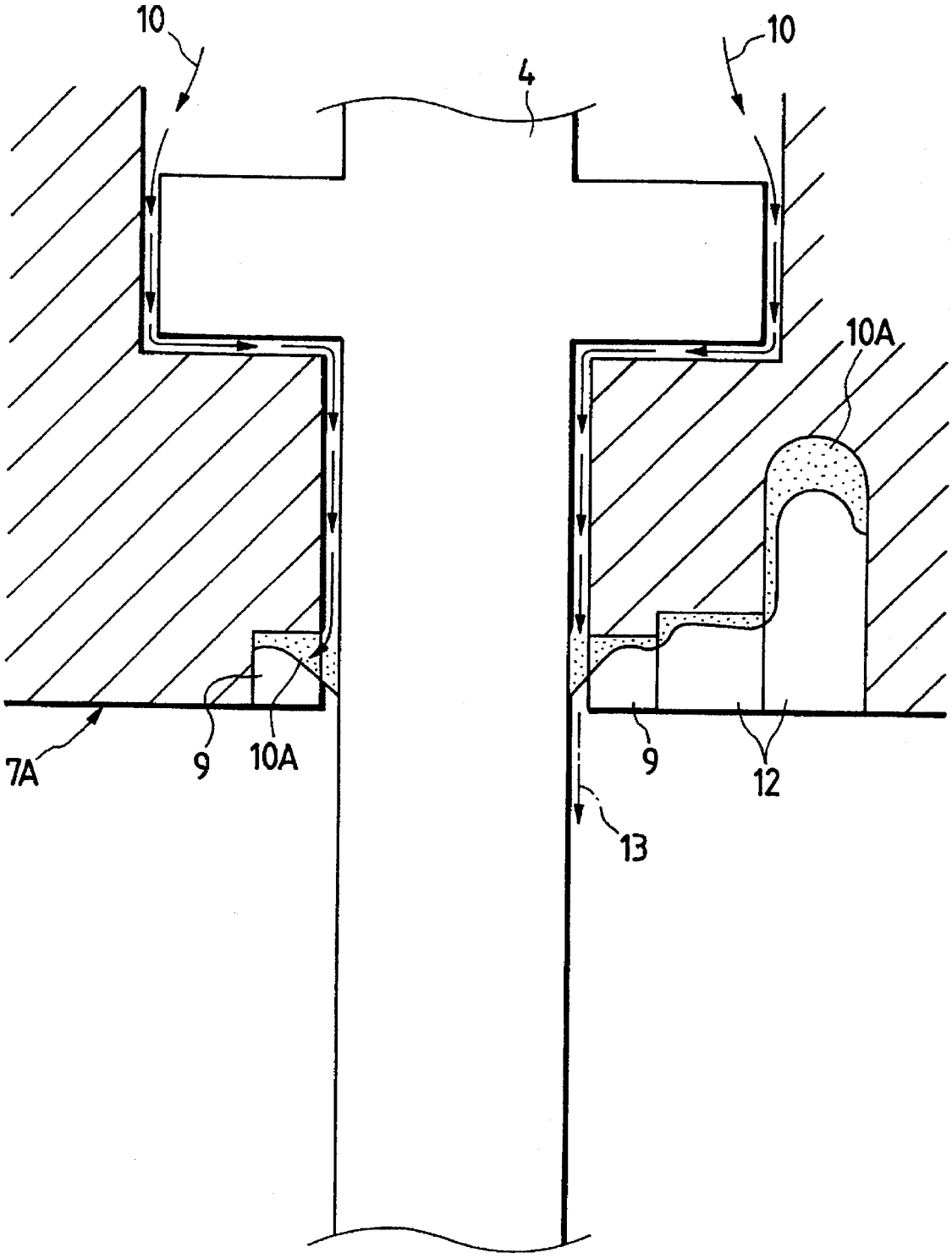
FIG. 4 is a schematic view showing a leakage of sealer in the connector device.
Figure 6:
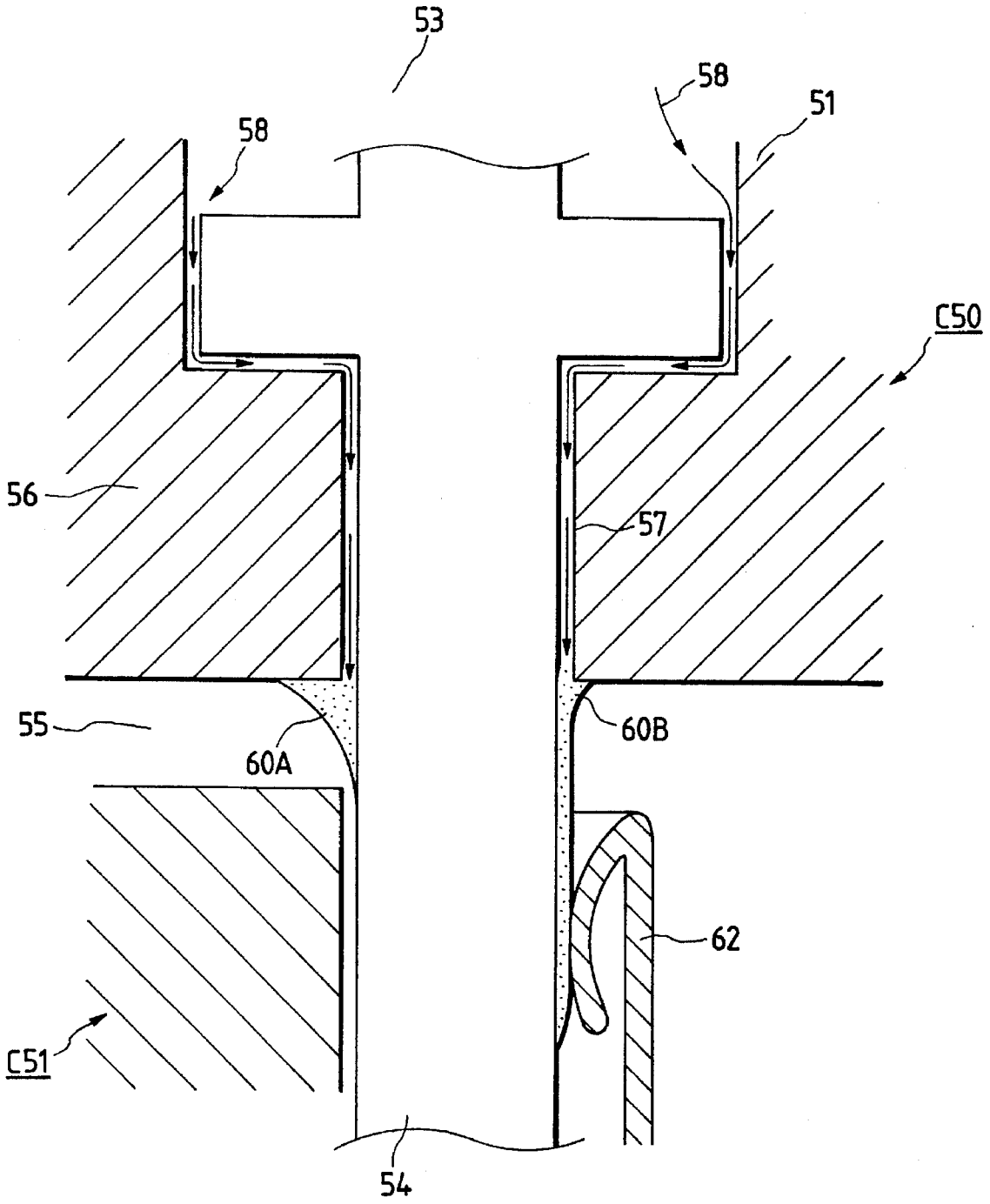
FIG. 6 is a schematic view showing leakage of a sealer in the conventional connector device.

A leak portion collecting portion 9 in the form of a recess is formed or notched in that portion of the fitting surface 7A to which the terminal passage hole 8 in the terminal support wall 7 is open, the leak portion collecting portion 9 being formed around the edge of the terminal passage hole 8. The leak portion collecting portion 9 is extended in a direction perpendicular to the axis of the terminal passage hole 8. As shown in FIGS. 2 and 3, there may be provided a surface diffusion chamber 12 which communicates with each leak portion collecting portion 9, and is deeper than this portion 9. The surface diffusion chamber 12 has a stepped bottom as shown in FIGS. 3 and 4.

Referring again to FIGS. 1 and 2, a liquid-state (uncured) resin is poured into and fills the space formed by the inner surface of the insertion hole 5 and the rubber plug 20. The thus poured resin is cured to provide the sealer 10. The sealer 10 prevents leaking oil from intruding into the insertion hole 5, and also serves to fix the wires 3 and the terminals 4, and further seals the front end portions of the wires 3 each having the peeled portion 3B from which the sheath 3A has been removed. With this arrangement, oil is prevented from diffusing into the wire 3 (that is, the gap between the sheath and a conductor portion) by capillary action.

The rubber plug 20, which sealingly closes the open end of the insertion hole 5 in the housing casing 2, prevents leakage of the liquid-state (uncured) resin (i.e., sealer 10), the deterioration of the sealer 10 by oil in an oil pan, and the intrusion of oil into a gap between the housing casing 2 and the sealer 10.

An O-ring 21 is fitted on the outer periphery of the housing casing 2, and when the housing casing 2 is fitted in a through hole in a transmission casing (not shown), the O-ring 21 forms a seal between the inner surface of this through hole and the outer periphery of the housing casing 2.

The procedure of assembling the connector device C of the above construction will now be described, and also the operation of this connector device C will be described with reference to FIG. 4 schematically showing a condition of leakage of sealer. The left portion of FIG. 4 schematically shows the sealer-leaked condition in a device having the leak portion collecting portion 9 while the right portion thereof schematically shows the sealer-lead condition in a device having the leak portion collecting portion 9 and the surface diffusion chamber 12.

For assembling the connector device C, the wires 3 each having the sheath 3A are passed respectively through the holes in the rubber plug 20, and then the terminals 4 are connected respectively to the peeled portions 3B of the wires 3 at the front ends thereof by clamping. The terminals 4 thus connected to the respective wires 3 are passed respectively through the terminal passage holes 8 in the terminal support wall 7 of the housing casing 2. In this condition, the front end portions 4A of the terminals 4 project into the fitting hole 6. Then, the rubber plug 20 is fitted in the insertion hole 5, and retained there.

Then, the liquid-state (uncured) resin is poured into the insertion hole 5. This poured resin is cured to form the sealer 10. The wires 3 and the terminals 4 are fixed to the housing casing 2 by the sealer 10.

When the sealer 10 is poured, part of the filled liquid-state (uncured) resin (hereinafter referred to as "sealer 10") may flow or leak through the gap between the terminal 4 and the terminal passage hole 8 to the outer end of the terminal passage hole 8 at the fitting surface 7A. This flow of the liquid-state (uncured) sealer 10 is conspicuous particularly when the sealer 10 is poured under pressure into the sealed insertion hole 5, or when the viscosity of the liquid-state sealer 10 is low, or when the gap between the terminal 4 and the terminal passage hole 8 is large.

In the connector device C of this invention, the thus flowing liquid-state sealer 10 is collected in the leak portion collecting portion 9 provided at the outer end of the terminal passage hole 8 open to the fitting hole 6. The leak portion collecting portion 9 has a sufficient capacity that a distal end of a sealer flow-out portion 10A formed as a result of curing of the collected outflow sealer will not project into the fitting hole 6, as shown in the left portion of FIG. 4. Therefore, a guide portion of the housing casing of the mating connector to be fitted in the fitting hole 6 will not impinge on the sealer flow-out portion 10A, so that the advance of the mating connector will not obstructed. Therefore, the two connectors can be completely fitted together.

The leak portion collecting portion 9 is in the form of a recess which is extended in the direction perpendicular to the axis of the terminal passage hole 8. Additionally, the surface diffusion chamber 12, comprising a pair of recesses deeper than the leak portion collecting portion 9, can be provided in communication with the leak portion collecting portion 9. With this arrangement, the wide surface area of the surface diffusion chamber 12 is added to the surface area of the leak portion collecting portion 9 and the large capacity of the surface diffusion chamber 12 is added to the capacity of the leak portion collecting portion 9.

The outflow sealer 10A proceeds and diffuses over the relevant surface with a surface tension, and therefore in the above interconnection surface arrangement in which the wide surface area of the surface diffusion chamber 12 is added to the surface area of the leak portion collecting portion 9, diffusion resistance is reduced, so that the diffusion of the sealer over the interconnection surface is accelerated. As a result, almost all of the outflow sealer 10A diffuses to the leak portion collecting portion 9 and the surface diffusion chamber 12, and are absorbed by the large capacity of these portions, as shown in the right portion of FIG. 4. Therefore, the outflow sealer 10A will not flow in the direction indicated by a broken line 13 in FIG. 4, and hence will not form a covering layer at all. As a result, such a covering layer resulting from the outflow sealer 10A is not formed on the terminal 4, and therefore the terminal 4 is not prevented from properly contacting the mating terminal.

Even if the liquid-state sealer leaks, it will not cover the front end portion of each terminal, and an incomplete contact between the terminals will not occur.

When the resin for forming the sealer is cured, the resin residing in the gap between the terminal passage hole 8 and the terminal 4, as well as the leaked resin residing in the leak portion collecting portion 9 and the surface diffusion chamber 12, is also cured, and therefore the resin over the entire range from the insertion hole 5 to the leak portion collecting portion 9 or the surface diffusion chamber 12 is cured, thus forming the integrally-cured resin. Therefore, the resin cured in the leak portion collecting portions 9 and the surface diffusion chambers 12 serve as retaining portions which prevent the sealer 10, cured in the insertion hole 5, from disengaging from the housing casing 2.

In the connector device of the invention, as described above, the terminal passage holes are formed through the terminal support wall of the housing casing, and the leak portion collecting portion is formed or notched at that end of each terminal passage hole open to the fitting hole, and is extended in the direction perpendicular to the axis of the terminal passage hole. The leak portion collecting portion receives the liquid-state sealer leaking through the gap between the terminal passage hole and the terminal, thereby preventing the liquid-state sealer from flowing and diffusing to the fitting surface of the terminal support wall.

Therefore, the fitting surface is maintained in a flat condition, so that the connector device and the mating connector can be completely fitted together.

The outflow sealer first flows into the leak portion collecting portion, and is cooled and cured there, and therefore the front end portion of the terminal will not be covered with the sealer.

If the surface diffusion chamber is provided in continuous relation to the leak part-collecting portion, the surface area of the wall is increased, and diffusion resistance is reduced, so that the diffusion of the liquid-state sealer to the surface of the leak portion collecting portion and the surface of the surface diffusion chamber is accelerated. As a result, almost all of the outflow sealer is diffused over the leak portion collecting portion and the surface diffusion chamber, and is absorbed by the large capacity of these portions. Therefore, the outflow sealer will not diffuse over the surface of the terminals at all, and a covering layer resulting from the outflow sealer will not form on the terminal, and therefore the terminal can properly contact the mating terminal, thus advantageously eliminating improper contact.

When the resin for forming the sealer is cured, the resin residing in the gap between the terminal passage hole and the terminal, as well as the leaked resin residing in the leak portion collecting portion and the surface diffusion chamber is also cured, and therefore the resin over the entire range from the insertion hole to the leak portion collecting portion is cured, thus forming the integrally-cured resin. Therefore, the resin cured in the leak portion collecting portions 9 serve as retaining portions which prevent the sealer, cured in the insertion hole, from disengaging from the housing casing.

What is claimed is:

1. A connector, comprising:

a housing having a fitting hole for mating with another connector and an insertion chamber for receiving a terminal, said terminal including an electrical contact portion and a wire connecting portion connected to a wire, said housing including a terminal supporting wall dividing said fitting hole and said insertion chamber, said terminal supporting wall having a terminal passage hole through which said electrical contact portion of said terminal passes;

a sealer material inserted in said insertion chamber, said sealer material being cured after said insertion; and sump means for collecting said sealer material leaked into said fitting hole through said terminal passage hole, said sump means being disposed around an edge of said terminal passage hole in said fitting hole.

2. The connector of claim 1, wherein said sump means includes a sump portion disposed around said edge of said terminal passage hole and a surface diffusion chamber in communication with said sump portion.

3. The connector of claim 2, wherein said surface diffusion chamber has a depth that is greater than a depth of said sump portion.

4. The connector of claim 3, wherein said surface diffusion chamber has a stepped bottom.

* * * * *